US010732544B2

(12) United States Patent
Higashimura

(10) Patent No.: US 10,732,544 B2
(45) Date of Patent: Aug. 4, 2020

(54) TONER REPLENISHING APPARATUS WITH AGITATION MEMBER, DEVELOPER, AND IMAGE FORMING APPARATUS

(71) Applicant: KONICA MINOLTA, INC., Chiyoda-ku, Tokyo (JP)

(72) Inventor: Hideji Higashimura, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/540,194

(22) Filed: Aug. 14, 2019

(65) Prior Publication Data

US 2020/0096906 A1 Mar. 26, 2020

(30) Foreign Application Priority Data

Sep. 26, 2018 (JP) ..... 2018-180580

(51) Int. Cl.
*G03G 15/08* (2006.01)

(52) U.S. Cl.
CPC ..... *G03G 15/0889* (2013.01); *G03G 15/0879* (2013.01)

(58) Field of Classification Search
CPC ..... G03G 15/0879; G03G 15/0889; G03G 15/0891; G03G 2215/0802
USPC ..... 399/254, 255, 256
See application file for complete search history.

(56) References Cited

U.S. PATENT DOCUMENTS 5,835,827 A * 11/1998 Kishimoto ..... B01F 7/32 399/254
8,750,767 B2 * 6/2014 Sunayama ..... G03G 15/0856 399/255
2008/0304838 A1 * 12/2008 Suenaga ..... G03G 15/553 399/27
2011/0206389 A1 * 8/2011 Naruse ..... G03G 15/0877 399/27
2012/0189351 A1 * 7/2012 Hayashi ..... G03G 15/0189 399/258
2018/0088508 A1 * 3/2018 Kawada ..... G03G 15/556
2019/0056681 A1 * 2/2019 Sakai ..... G03G 15/0889

FOREIGN PATENT DOCUMENTS

JP 05188778 A * 7/1993
JP 2006258837 A * 9/2006
JP 2010002671 A 1/2010
JP 2013068703 A * 4/2013

* cited by examiner

*Primary Examiner* — Robert B Beatty
(74) *Attorney, Agent, or Firm* — Buchanan Ingersoll & Rooney PC

(57) ABSTRACT

A toner replenishing apparatus includes: a toner storage that stores toner for replenishment; an agitation paddle that is arranged in the toner storage and rotates to agitate toner stored in the toner storage; a conveyance member that is disposed in a lower part of the toner storage and is used to convey the toner stored in the toner storage toward a developer; and an agitation member that moves along with rotation of the agitation paddle, wherein the conveyance member is arranged away from the agitation paddle in a plan view, and the agitation member agitates the toner located above the conveyance member, which is a part of the toner stored in the toner storage.

12 Claims, 7 Drawing Sheets

TONER REPLENISHING APPARATUS WITH AGITATION MEMBER, DEVELOPER, AND IMAGE FORMING APPARATUS

The entire disclosure of Japanese patent Application No. 2018-180580, filed on Sep. 26, 2018, is incorporated herein by reference in its entirety.

BACKGROUND

Technological Field

The present disclosure relates to a toner replenishing apparatus, a developer, and an image forming apparatus.

Description Of The Related Art

Examples of a document that discloses a conventional toner replenishing apparatus include JP 2010-002671 A.

In the toner replenishing apparatus disclosed in JP 2010-002671 A, an agitation paddle that agitates toner stored in a toner storage container is disposed above a conveyance member that conveys the toner in the toner storage container toward a developer.

However, in a case in which a toner storage is increased in capacity in order that the toner storage may store more toner, it is sometimes difficult to adopt a configuration in which an agitation paddle is arranged above a conveyance member, as disclosed in JP 2010-002671 A.

In a case in which a conveyance member is arranged away from an agitation paddle in a plan view, it becomes difficult to agitate toner located above the conveyance member, which is a part of toner stored in a toner storage, and there is a concern that the toner accumulates in that area. In such a case, fluidity of the toner reduces, and this may cause unstable replenishment of the toner to a developer.

SUMMARY

The present disclosure has been made in view of the above issue, and an object of the present disclosure is to provide a toner replenishing apparatus, a developer, and an image forming apparatus that allow toner to flow with stability.

To achieve the abovementioned object, according to an aspect of the present invention, a toner replenishing apparatus reflecting one aspect of the present invention comprises: a toner storage that stores toner for replenishment; an agitation paddle that is arranged in the toner storage and rotates to agitate toner stored in the toner storage; a conveyance member that is disposed in a lower part of the toner storage and is used to convey the toner stored in the toner storage toward a developer; and an agitation member that moves along with rotation of the agitation paddle, wherein the conveyance member is arranged away from the agitation paddle in a plan view, and the agitation member agitates the toner located above the conveyance member, which is a part of the toner stored in the toner storage.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
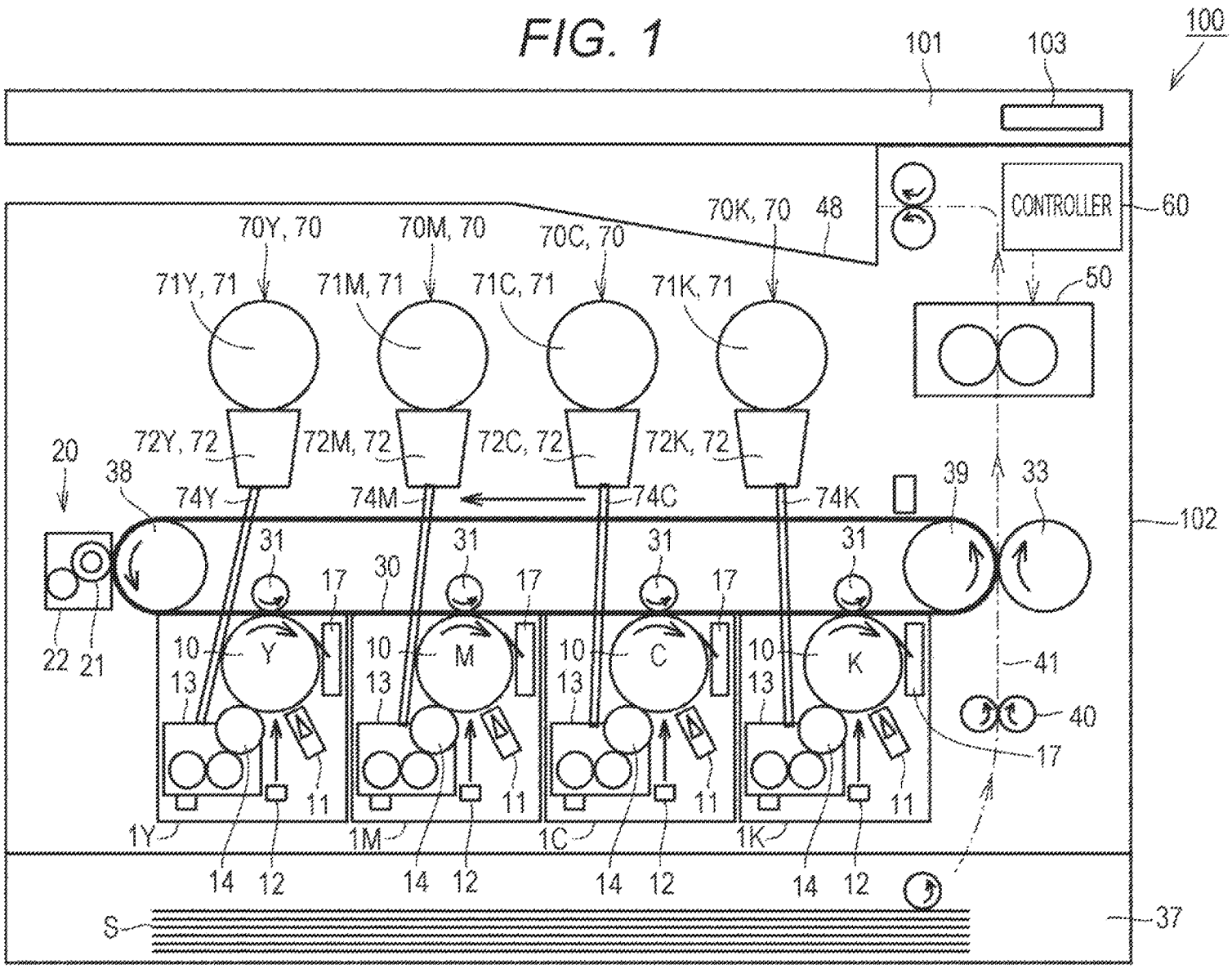
FIG. 1 is a schematic view illustrating an image forming apparatus according to an embodiment.

Hereinafter, one or more embodiments of the present invention will be described with reference to the drawings. However, the scope of the invention is not limited to the disclosed embodiments. In the embodiment described below, the same or common parts will be denoted by the same reference numerals in the drawings, and the repeated description thereof will be omitted.

FIG. 1 is a schematic view illustrating an image forming apparatus according to the embodiment. An image forming apparatus 100 according to the embodiment will be described with reference to FIG. 1.

As illustrated in FIG. 1, the image forming apparatus 100 mainly includes an image reader 101 that reads a manuscript image and a printer 102 that prints an image.

The image reader 101 includes an operation panel 103. The operation panel 103 has an input part having functions including a touch sensor and a group of various input keys including a numeric keypad. The operation panel 103 also has a display part having functions including a liquid crystal display integrated with the touch sensor and various indicators including a light emitting diode (LED).

The printer 102 includes image forming units 1Y, 1M, 1C, and 1K, an intermediate transfer belt 30, primary transfer rollers 31, a secondary transfer roller 33, a cassette 37, a driven roller 38, a drive roller 39, a timing roller 40, a fuser 50, a controller 60, toner replenishing apparatuses 70Y, 70M, 70C, and 70K (each individually referred to as simply the toner replenishing apparatus 70 in a case in which no distinction is made among them), and a cleaning device 20.

The image forming units 1Y, 1M, 1C, and 1K are arranged in this order along the intermediate transfer belt 30. The image forming units 1Y, 1M, 1C, and 1K form toner images with toner replenished from the toner replenishing apparatuses 70Y, 70M, 70C, and 70K respectively.

The image forming unit 1Y forms a yellow (Y) toner image with toner replenished from the toner replenishing apparatus 70Y. The image forming unit 1M forms a magenta (M) toner image with toner replenished from the toner replenishing apparatus 70M. The image forming unit 1C forms a cyan (C) toner image with toner replenished from the toner replenishing apparatus 70C. The image forming unit 1K forms a black (BK) toner image with toner replenished from the toner replenishing apparatus 70K.

The toner replenishing apparatuses 70Y, 70M, 70C, and 70K include toner bottles (toner containers) 71Y, 71M, 71C, and 71K respectively and toner storages 72Y, 72M, 72C, and 72K respectively. The toner bottles 71Y, 71M, 71C, and 71K are referred to as the toner bottle 71 in a case in which no distinction is made among them, and the toner storages 72Y, 72M, 72C, and 72K are referred to as the toner storage 72 in a case in which no distinction is made among them.

The toner bottles 71Y, 71M, 71C, and 71K are removably mounted on the toner storages 72Y, 72M, 72C, and 72K respectively. The toner storages 72Y, 72M, 72C, and 72K temporarily store toner supplied from the toner bottles 71Y, 71M, 71C, and 71K respectively. When the amounts of toner remaining in the toner storages 72Y, 72M, 72C, and 72K become low, toner is supplied from the toner bottles 71Y, 71M, 71C, and 71K respectively.

The toner storages 72Y, 72M, 72C, and 72K replenish toner via supply paths 74Y, 74M, 74C, and 74K respectively to developers 13 of the image forming units 1Y, 1M, 1C, and 1K respectively.

The image forming units 1Y, 1M, 1C, and 1K are arranged along the intermediate transfer belt 30 in this order in the direction of rotation of the intermediate transfer belt 30. Each of the image forming units 1Y, 1M, 1C, and 1K includes a photoreceptor 10 as an image carrier, a charging device 11, an exposure device 12, the developer 13, and a cleaning device 17.

The charging device 11 uniformly charges the surface of the photoreceptor 10. The exposure device 12 irradiates the photoreceptor 10 with a laser beam in response to a control signal from the controller 60 to expose the surface of the photoreceptor 10 according to an input image pattern. This causes an electrostatic latent image corresponding to an input image to be formed on each photoreceptor 10.

While rotating a developing roller 14, the developer 13 applies a developing bias to the developing roller 14 and deposit toner on the surface of the developing roller 14. The toner is thereby transferred from the developing roller 14 to the photoreceptor 10, and a toner image corresponding to the electrostatic latent image is developed on the surface of the photoreceptor 10. The developer 13 develops the electrostatic latent image formed on the photoreceptor 10 to form the toner image on the photoreceptor 10.

The photoreceptor 10 and the intermediate transfer belt 30 are in contact with each other in an area where the primary transfer roller 31 is disposed. The primary transfer roller 31 has a roller-like configuration and is rotatable. Applying, to the primary transfer roller 31, a transfer voltage that is opposite in polarity to the toner image causes the toner image to be transferred from the photoreceptor 10 to the intermediate transfer belt 30.

A yellow (Y) toner image, a magenta (M) toner image, a cyan (C) toner image, and a black (BK) toner image are superimposed in this order and transferred from the photoreceptors 10 to the intermediate transfer belt 30. This causes a color toner image to be formed on the intermediate transfer belt 30.

The intermediate transfer belt 30 is stretched by the driven roller 38 and the drive roller 39. The drive roller 39 is rotationally driven by, for example, a motor (not illustrated). The intermediate transfer belt 30 and the driven roller 38 rotate along with the drive roller 39. This causes the toner image on the intermediate transfer belt 30 to be conveyed to the secondary transfer roller 33.

The cleaning device 17 is pressed against the photoreceptor 10. The cleaning device 17 collects residual toner on the surface of the photoreceptor 10 after transfer of the toner image.

The cassette 37 contains paper S as a recording medium. The paper S is sent, one sheet at a time, by the timing roller 40 from the cassette 37 to the secondary transfer roller 33 along a conveyance path 41.

The secondary transfer roller 33 has a roller-like configuration and is rotatable. The secondary transfer roller 33 applies, to the paper S being conveyed, a transfer voltage that is opposite in polarity to the toner image. This causes the toner image to be attracted from the intermediate transfer belt 30 to the secondary transfer roller 33, and the toner image on the intermediate transfer belt 30 is thus transferred. The primary transfer rollers 31, the intermediate transfer belt 30, and the secondary transfer roller 33 correspond to a transfer part that transfers the toner images developed by the developers 13 to the paper S (recording medium).

On the other hand, residual toner on the intermediate transfer belt 30 is removed by the cleaning device 20. The cleaning device 20 has a transfer belt cleaner 21 and a waste toner box 22. The residual toner is collected by the transfer belt cleaner 21 and stored in the waste toner box 22.

A timing at which the paper S is conveyed to the secondary transfer roller 33 is adjusted by the timing roller 40 according to a position of the toner image on the intermediate transfer belt 30. The timing roller 40 transfers the toner image on the intermediate transfer belt 30 to an appropriate position on the paper S.

The fuser 50 applies pressure and heat to the paper S that passes through the fuser 50. This causes the toner image to be fixed on the paper S. After that, the paper S is discharged to a tray 48.

Figure 2:
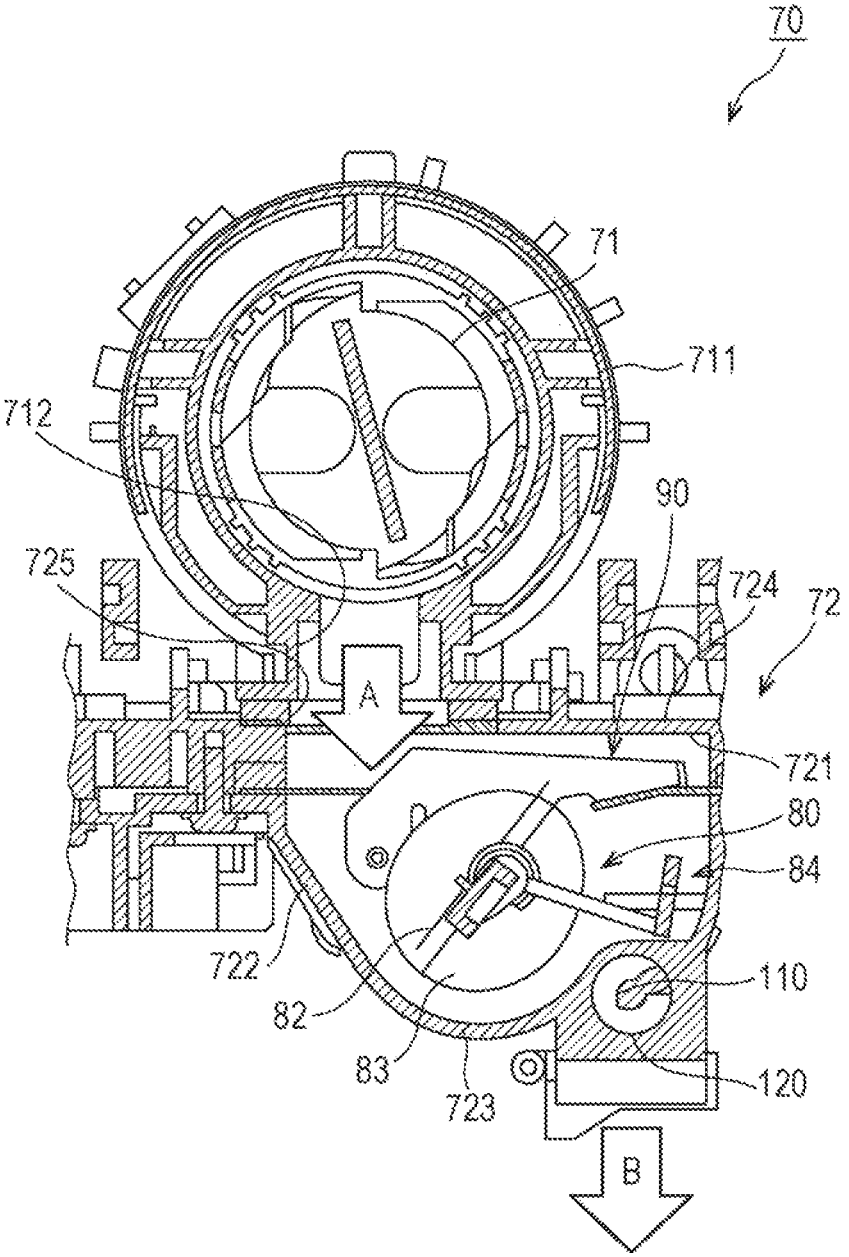
FIG. 2 is a sectional view of a toner replenishing apparatus according to the embodiment.
Figure 3:
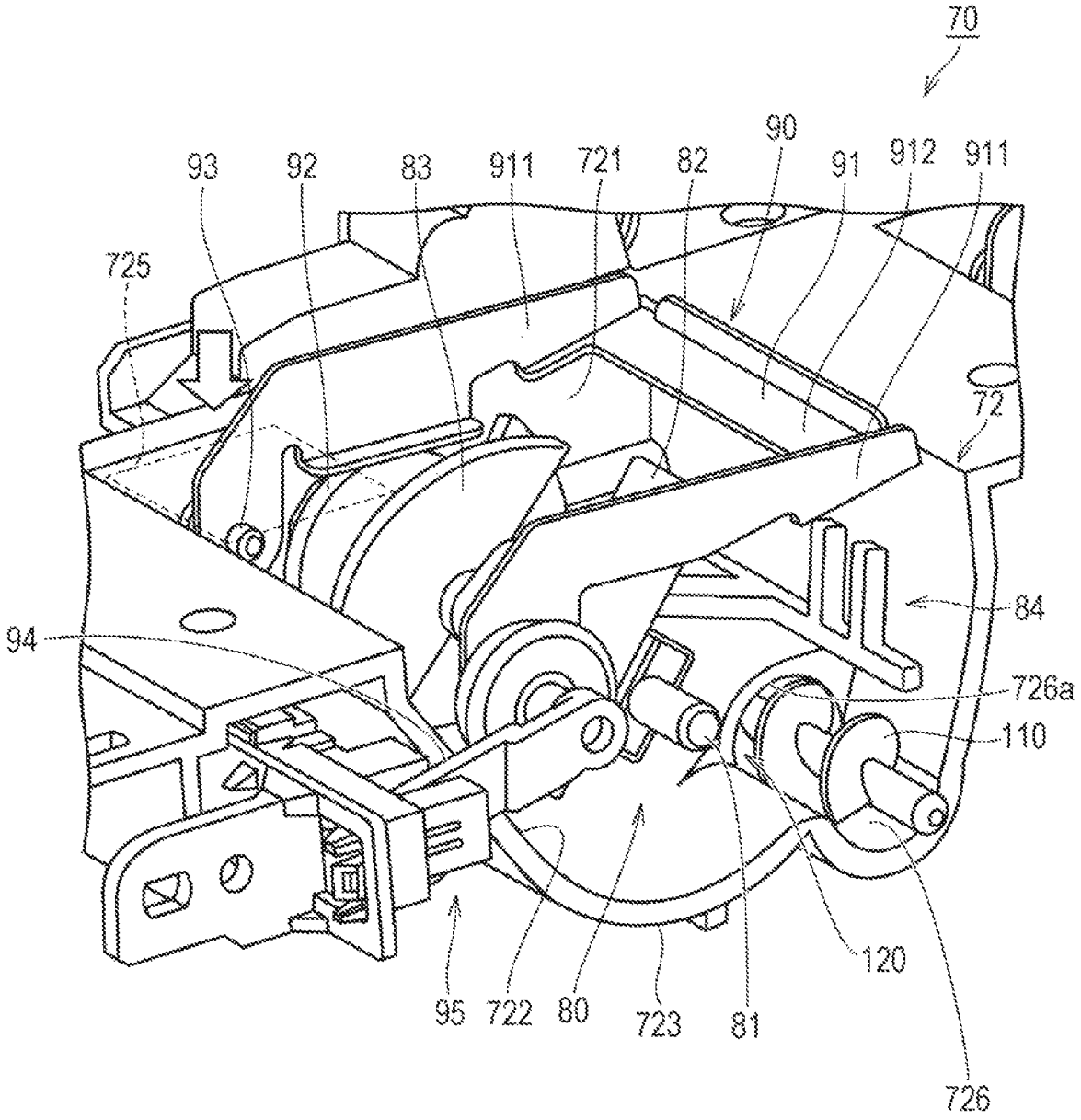
FIG. 3 is a perspective sectional view of the toner replenishing apparatus according to the embodiment.

FIG. 2 is a sectional view of a toner replenishing apparatus according to the embodiment. FIG. 3 is a perspective sectional view of the toner replenishing apparatus according to the embodiment. In FIG. 3, a configuration around the toner bottle is omitted from illustration. The toner replenishing apparatus 70 will be described with reference to FIGS. 2 and 3.

The toner replenishing apparatus 70 includes the toner bottle 71, the toner storage 72, an agitator 80, a toner remaining amount detector 90, and a conveyance member 110.

The toner storage 72 has a pair of opposed sides 721 having a planar configuration, a bottom 723 that couples the opposed sides 721 and partially constitutes a guide wall 722 described later, and a lid 724 that covers the top of the toner storage 72. Moreover, an introduction port 725 and a toner take-in part 726 are disposed in the toner storage 72. The introduction port 725 is used to introduce toner from the toner bottle 71 into the toner storage 72. The toner take-in part 726 is used to take toner into a replenishment path 120 for replenishment of toner to the developer 13.

The toner take-in part 726 is located away from the introduction port 725 at least in the direction of a rotation axis CL1 (see FIG. 4) of a rotation shaft 81 described later. The introduction port 725 and the toner take-in part 726 are located at positions where the introduction port 725 and the toner take-in part 726 do not overlap with each other. Arranging the introduction port 725 and the toner take-in part 726 in this way allows an increase in the amount of toner stored in the toner storage 72. For example, the introduction port 725 and the toner take-in part 726 are arranged at diagonal corners of the toner storage 72 when viewed from above (in a plan view).

The pair of sides 721 is arranged in line in the direction of the rotation axis CL1 (see FIG. 4) of the rotation shaft 81. The pair of sides 721 is arranged parallel to each other, and each of the pair of sides 721 is orthogonal to the bottom 723. This configuration of the toner storage 72 is not restrictive, and various configurations that can store supplied toner can be adopted.

The lid 724 covers an opening of the toner storage 72 that opens upward. The lid 724 is connected with a bottle holder 711 for mounting the toner bottle 71. The introduction port 725 is disposed in the lid 724. The introduction port 725 is disposed immediately below a discharge port 712 of the toner bottle 71. Toner discharged from the discharge port 712 is introduced through the introduction port 725 into the toner storage 72.

The guide wall 722 is arranged immediately below the introduction port 725. The guide wall 722 slopes down toward the agitator 80. The toner supplied from the introduction port 725 is guided toward the agitator 80 by the guide wall 722.

The toner take-in part 726 and the conveyance member 110 are disposed in a lower part of the toner storage 72. The conveyance member 110 is used to convey toner stored in the toner storage 72 toward the developer 13. Specifically, the conveyance member 110 conveys toner into the replenishment path 120 connected with the toner take-in part 726 of the toner storage 72. The conveyance member 110 gets into the replenishment path 120 through the toner take-in part 726, and extends along the replenishment path 120. In a plan view, the conveyance member 110 is arranged away from an agitation paddle 82 described later.

A first end side of the replenishment path 120 is connected with a take-in port 726*a* disposed in the toner storage 72. Toner is taken into the replenishment path 120 through the take-in port 726*a*. A second end side of the replenishment path 120 is connected with the supply path 74 described above. The replenishment path 120 is provided substantially horizontal. The replenishment path 120 extends, for example, along the direction of the rotation axis CL1.

The agitator 80 includes the rotation shaft 81, the agitation paddle 82, a screw part 83, and an agitation member 84. The rotation shaft 81 is rotated by a drive part that is not illustrated. The agitation paddle 82 has a plate-like configuration. The agitation paddle 82 and the screw part 83 are disposed on the rotation shaft 81. That is, the screw part 83 is disposed on the rotation shaft 81 on which the agitation paddle 82 is disposed. The configuration of the agitator 80 can be simplified by disposing the agitation paddle 82 and the screw part 83 on the rotation shaft 81, that is, on a single shaft, in this way.

The agitation paddle 82 and the screw part 83 are rotatable about their rotation axes. As the rotation shaft 81 rotates, the agitation paddle 82 and the screw part 83 rotate. The screw part 83 conveys toner toward the agitation paddle 82. The screw part 83 conveys toner along the direction of the rotation axis of the agitation paddle 82. In the embodiment, the rotation axis of the agitation paddle 82 and the rotation axis of the screw part 83 coincide with the rotation axis CL1 of the rotation shaft 81.

The screw part 83 is arranged nearer to the introduction port 725 than the agitation paddle 82. The agitation paddle 82 is arranged nearer to the toner take-in part 726 than the screw part 83. Arranging the screw part 83 and the agitation paddle 82 in this way allows the screw part 83 to efficiently convey toner supplied from the introduction port 725 toward the agitation paddle 82 as described later.

The rotation shaft 81 is connected with another shaft 87 (see FIG. 4) as described later. The agitation member 84 is disposed on the shaft 87. The agitation member 84 is movable along with rotation of the agitation paddle 82. As the rotation shaft 81 rotates, the shaft 87 moves, and this causes the agitation member 84 to move. The agitation member 84 is swingable in a direction that intersects with the direction of the rotation axis of the screw part 83.

The agitation member 84 is arranged above the conveyance member 110. The agitation member 84 agitates toner located above the conveyance member 110, which is a part of toner stored in the toner storage 72. Moreover, the agitation member 84 is arranged below a toner surface against which a toner remaining amount detection member 91 described later abuts. This causes the agitation member 84 to agitate toner located below the toner surface against which the toner remaining amount detection member 91 abuts.

The agitation member 84 is swingable in a direction that intersects with the direction of displacement of the toner liquid surface. Specifically, the agitation member 84 is swingable in a direction orthogonal to the direction of displacement of the toner surface.

The toner remaining amount detector 90 can detect the remaining amount of toner stored in the toner storage 72. The toner remaining amount detector 90 includes the toner remaining amount detection member 91, an eccentric cam 92, a movable piece 94, and a photoelectric sensor 95.

The toner remaining amount detection member 91 has a pair of arms 911 and a sensing plate 912 that connects ends of the pair of arms 911. The pair of arms 911 is pivotally secured to pins 93 disposed on the pair of sides 721 of the toner storage 72. This allows the toner remaining amount detection member 91 to move between a retreat position where the toner remaining amount detection member 91 retreats from the toner liquid surface and an abutment position where the toner remaining amount detection member 91 abuts against the toner liquid surface. The toner remaining amount detection member 91 pivots between the retreat position and the abutment position.

The eccentric cam 92 is secured to the rotation shaft 81, and rotates eccentrically about the rotation axis CL1. The eccentric cam 92 rotates in synchronization with the rotation axis CL1. One of the arms 911 abuts against the eccentric cam 92. This causes the arms 911 to pivot along with rotation of the eccentric cam 92 and the toner remaining amount detection member 91 to pivot about the pins 93.

The movable piece 94 pivots along with pivotal movement of the arms 911. The movable piece 94 pivots so as to get into space between a light-emitting part and a light-receiving part included in the photoelectric sensor 95. The photoelectric sensor 95 senses the amount of remaining toner by a change in light intensity of detection light emitted from the light-emitting part toward the light-receiving part caused by movement of the movable piece 94.

Figure 4:
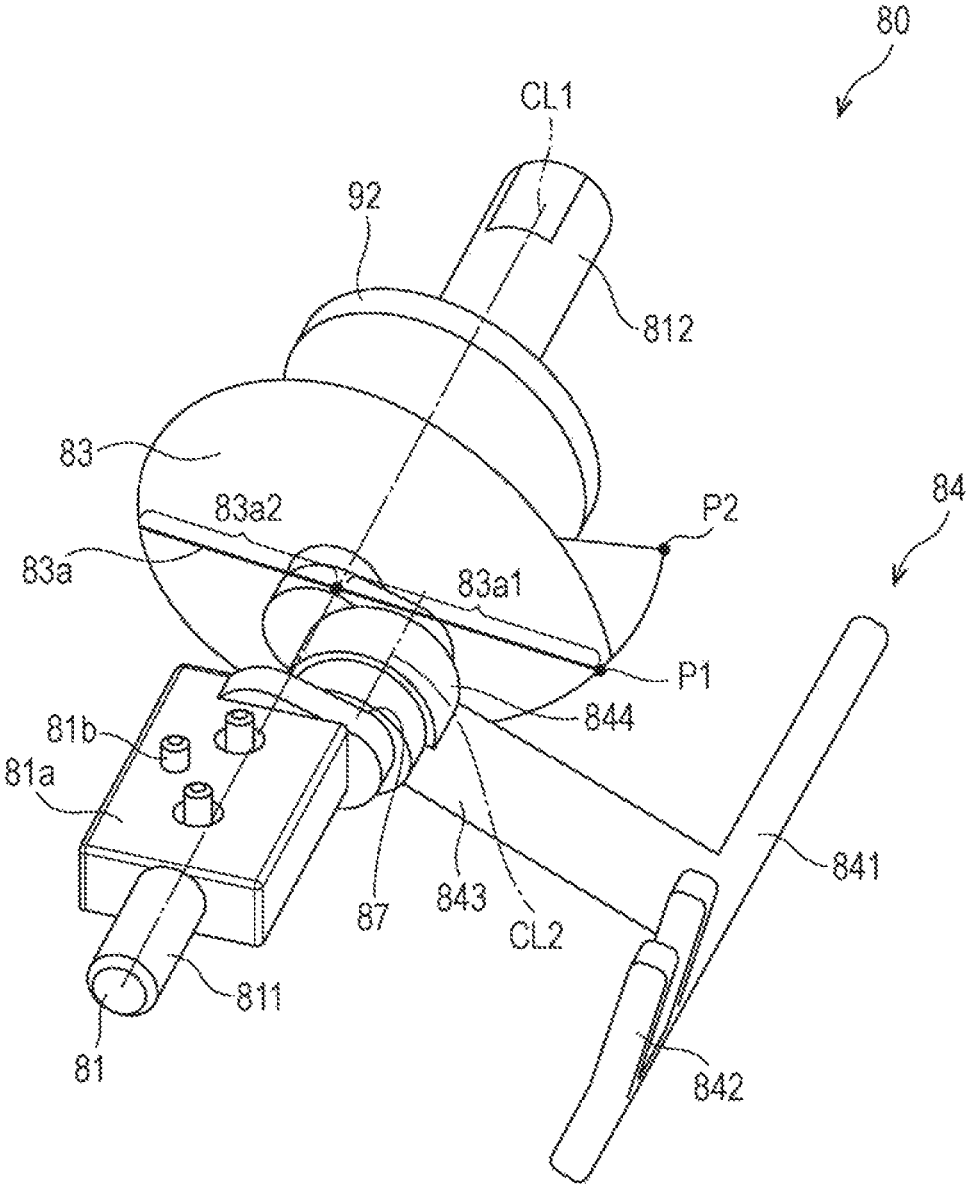
FIG. 4 is a view partially illustrating an agitator contained in the toner replenishing apparatus according to the embodiment.
Figure 5:
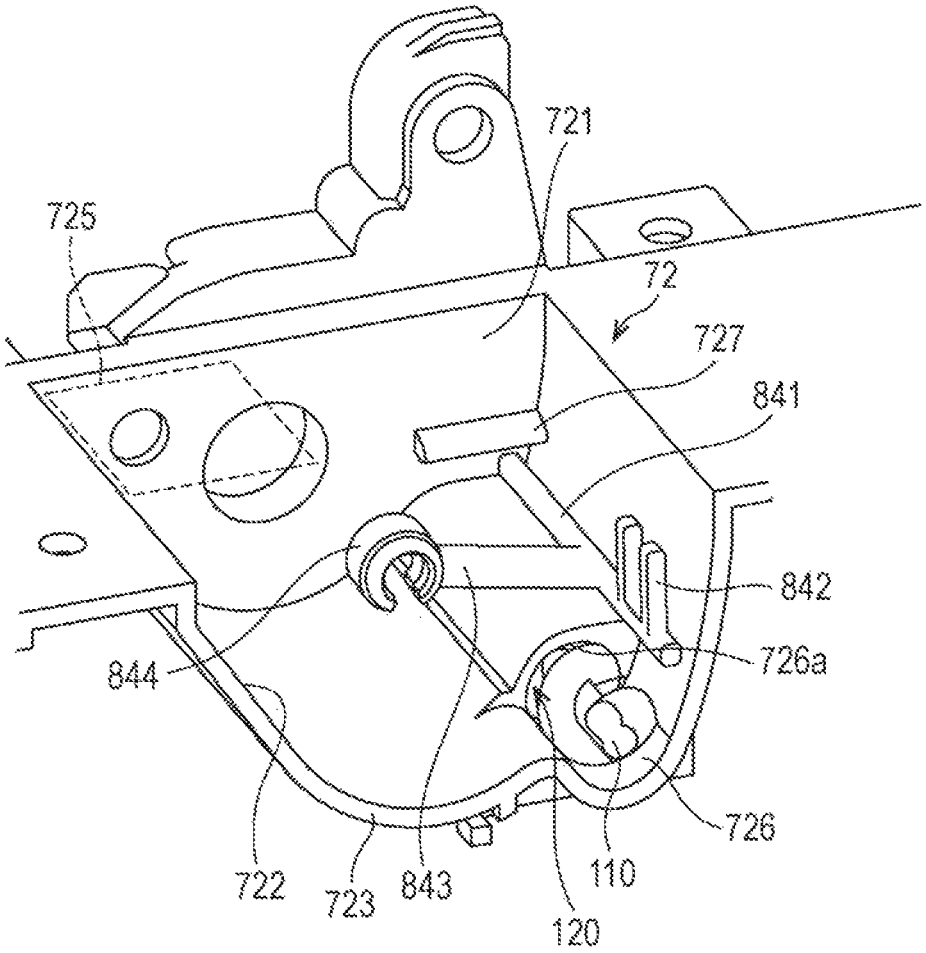
FIG. 5 is a perspective view illustrating an agitation member according to the embodiment.
Figure 6:
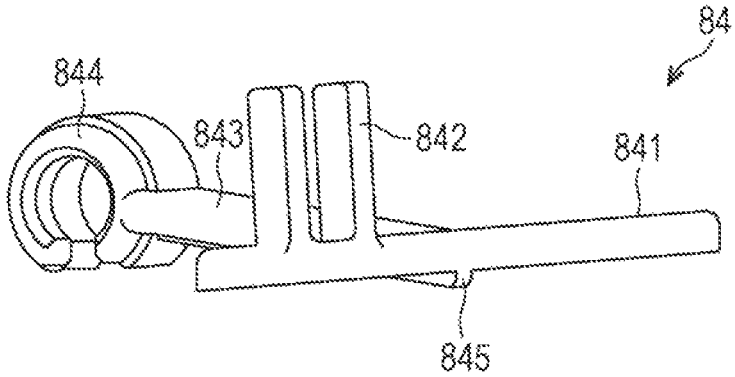
FIG. 6 is a perspective view illustrating a configuration of the agitation member and surroundings thereof according to the embodiment.

FIG. 4 is a diagram partially illustrating an agitator contained in the toner replenishing apparatus according to the embodiment. FIG. 5 is a perspective view illustrating an agitation member according to the embodiment. FIG. 6 is a perspective view illustrating a configuration of the agitation member and surroundings thereof according to the embodiment. The configuration of the agitator 80 will be described in detail with reference to FIGS. 4 to 6.

As illustrated in FIG. 4, the rotation shaft 81 has a first part 811 and a second part 812. The first part 811 and the second part 812 are arranged in line in the direction of the rotation axis CL1. A mount 81*a* for mounting the agitation paddle 82 is disposed on the first part 811. A stud 81*b* is disposed on a flat surface of the mount 81*a*, and projects in a direction orthogonal to the flat surface. The agitation paddle 82 engages with the stud 81*b*, and the agitation paddle 82 is thus secured to the first part 811.

The screw part 83 and the eccentric cam 92 are disposed on the second part 812. The screw part 83 has an elliptical shape when viewed from the direction of the rotation axis of the screw part 83. The screw part 83 has a spiral configuration. When viewed from the direction of the rotation axis of the screw part 83, a spiral start position P1 of the screw part 83 and a spiral end position P2 of the screw part 83 are located on a major axis 83*a* of the screw part 83. Such a positional relationship allows for enhancement of ability of the screw part 83 to convey toner. The spiral is wound in approximately one turn. When viewed from the direction of the rotation axis of the screw part 83, the spiral start position P1 and the spiral end position P2 overlap with each other.

The major axis 83*a* has a first part 83*a*1 and a second part 83*a*2. When viewed from the direction of the rotation axis of the screw part 83, the first part 83*a*1 projects from the rotation axis of the screw part 83, and the second part 83*a*2 projects shorter than the first part 83*a*1 from the rotation axis of the screw part 83 in a direction opposite to the first part 83*a*1.

The shaft 87 is connected between the first part 811 and the second part 812 of the rotation shaft 81 and is rotatable about the rotation axis CL1. The shaft 87 revolves about the rotation axis CL1. The direction of a central axis CL2 of the shaft 87 is parallel to the direction of the rotation axis CL1 of the rotation shaft 81. The agitation member 84 is fitted onto the shaft 87.

As illustrated in FIGS. 4 to 6, the agitation member 84 includes an extension 841, a projection 842, a mount 843, and a protrusion 845.

The extension 841 extends along the direction of the rotation axis CL1 of the rotation shaft 81, that is, the direction of the rotation axis of the agitation paddle 82. The extension 841 extends in a direction orthogonal to the direction of displacement of the toner surface (vertical direction) and the direction of swing of the agitation member 84. The extension 841 has a rod-like configuration.

The projection 842 projects from the extension 841 toward the toner liquid surface. The projection 842 projects upward from the extension 841. The projection 842 is disposed on a first end side of the extension 841. The projection 842 is disposed nearer to the toner take-in part 726 than to the introduction port 725 (FIG. 3). The projection 842 is located above the conveyance member 110 exposed in the toner storage 72.

The protrusion 845 protrudes from the extension 841 toward the bottom 723 of the toner storage 72. The protrusion 845 protrudes downward from the extension 841. The protrusion 845 is slidable on the bottom 723 of the toner storage 72. Disposing the protrusion 845 in this way can reduce friction between the agitation member 84 and the bottom 723, thereby allowing the agitation member 84 to swing stably. Moreover, the protrusion 845 forms a gap between the extension 841 and the bottom 723 so as not to let toner aggregate.

The mount 843 is disposed in the middle of the extension 841. The mount 843 extends toward the shaft 87. A hook 844 to be hooked onto the shaft 87 is disposed on an end of the mount 843. The hook 844 has a cylindrical configuration partially cut away in a circumferential direction. The hook 844 is fitted loosely on the shaft 87. The hook 844 is fitted onto the shaft 87 with a gap therebetween so as not to let toner aggregate between the hook 844 and the shaft 87.

The hook 844 is fitted onto the shaft 87 and is movable about the central axis CL2 of the shaft 87. This causes the hook 844 to pivot with respect to the shaft 87 so that the extension 841 may be suppressed from moving upward even when the shaft 87 rotates about the rotation axis CL1.

Moreover, a movement limiting part 727 is disposed on an inner surface of the toner storage 72 or, more specifically, on the side 721. The movement limiting part 727 limits upward movement of the extension 841. The movement limiting part 727 projects from the side 721 in its normal direction. The movement limiting part 727 extends along the direction of swing of the extension 841.

The shaft 87 pivots about the rotation axis CL1 with this movement limiting part 727 limiting upward movement of the extension 841, and this allows the extension 841 to swing in a direction that intersects with the rotation axis CL1. Specifically, the extension 841 can swing in a direction orthogonal to the direction of displacement of the toner liquid surface (vertical direction) and the direction of the rotation axis CL1. This causes the extension 841 to swing along with rotation of the rotation shaft 81, that is, rotation of the agitation paddle 82.

Figure 7:
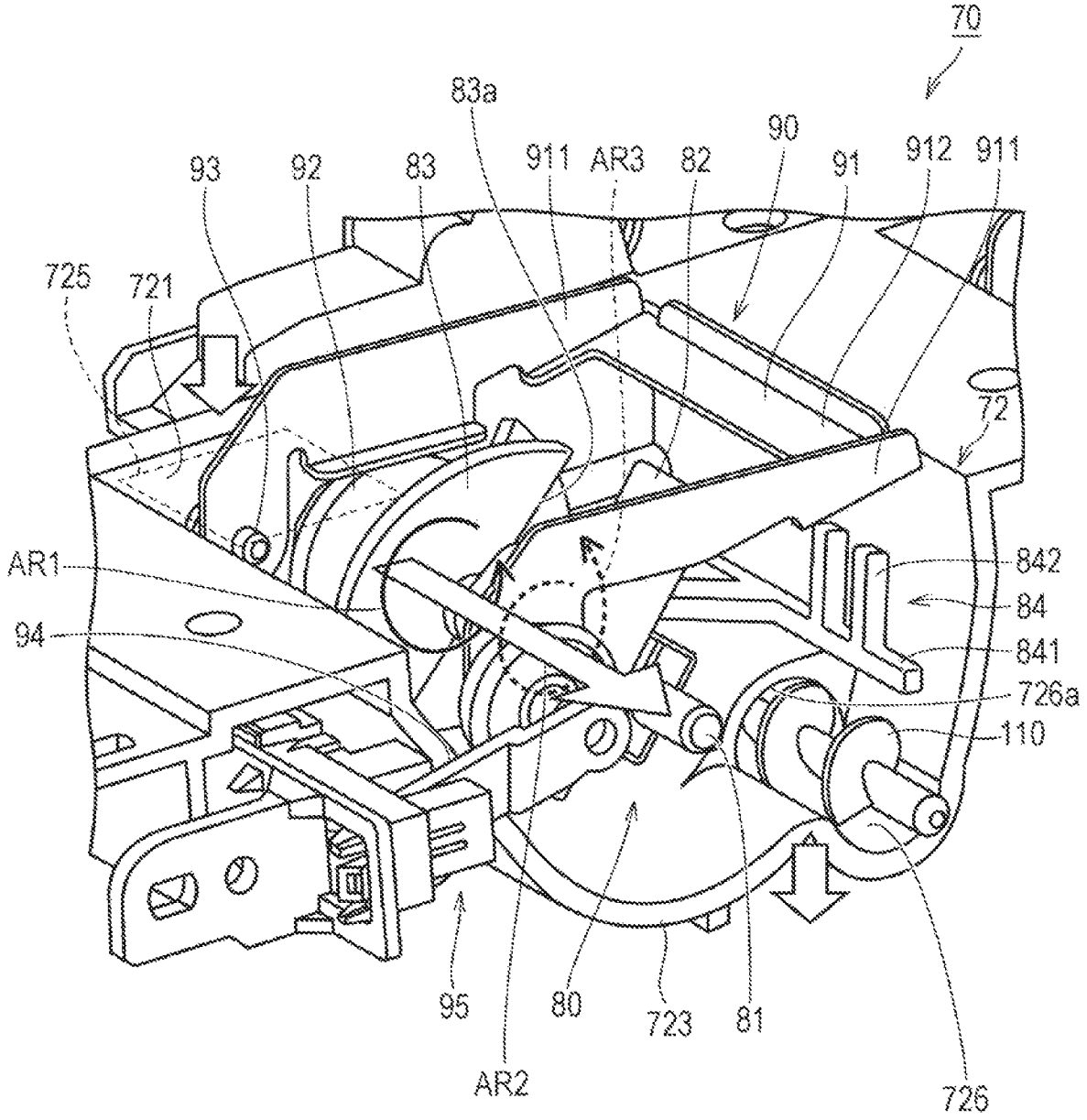
FIG. 7 is a perspective sectional view illustrating a screw part and an agitation paddle agitating toner in the toner replenishing apparatus according to the embodiment.

FIG. 7 is a perspective sectional view illustrating a screw part and an agitation paddle agitating toner in the toner replenishing apparatus according to the embodiment. How the screw part 83 and the agitation paddle 82 agitate toner will be described with reference to FIG. 7.

As illustrated in FIG. 7, as the rotation shaft 81 rotates about the rotation axis CL1 (see FIG. 4), the screw part 83 and the agitation paddle 82 rotate about the rotation axis CL1. As the screw part 83 rotates as indicated by an arrow AR1, toner stored in the toner storage 72 is conveyed along the direction of the rotation axis CL1 toward the agitation paddle 82 as indicated by an arrow AR2. The agitation paddle 82 rotates as indicated by an arrow AR3 to agitate toner conveyed by the screw part 83 and move a part of the conveyed toner to the toner take-in part 726.

As described above, the agitation paddle 82 agitates toner conveyed along the rotation axis CL1, and thus toner that accumulates at a position away from the toner take-in part 726 in the direction of the rotation axis CL1 can be conveyed by the screw part 83 and agitated. This suppresses toner from hardening at a position away from the toner take-in part 726 in the direction of the rotation axis CL1, and allows the toner to flow with stability.

Moreover, arranging the screw part 83 nearer to the introduction port 725 than the agitation paddle 82 and arranging the agitation paddle 82 nearer to the toner take-in part 726 than the screw part 83 allow toner that accumulates near the introduction port 725 to be conveyed toward the agitation paddle 82 by the screw part 83. This suppresses toner from hardening near the introduction port 725.

Furthermore, the agitation paddle 82 having a plate-like configuration is parallel to the major axis 83*a* of the screw part 83 when viewed from the direction of the rotation axis of the screw part 83 (the direction of the rotation axis CL1 of the rotation shaft 81), and a rotation phase of the agitation paddle 82 and a rotation phase of the screw part 83 are substantially the same.

As described above, when viewed from the direction of the rotation axis of the screw part 83, the spiral start position P1 and the spiral end position P2 of the screw part 83 are located on the major axis 83*a* of the screw part 83. This enhances the conveying ability of the screw part 83, thereby allowing liberally conveyed toner to be agitated by the agitation paddle 82. This allows toner in the toner storage 72 to be agitated efficiently.

Figure 8:
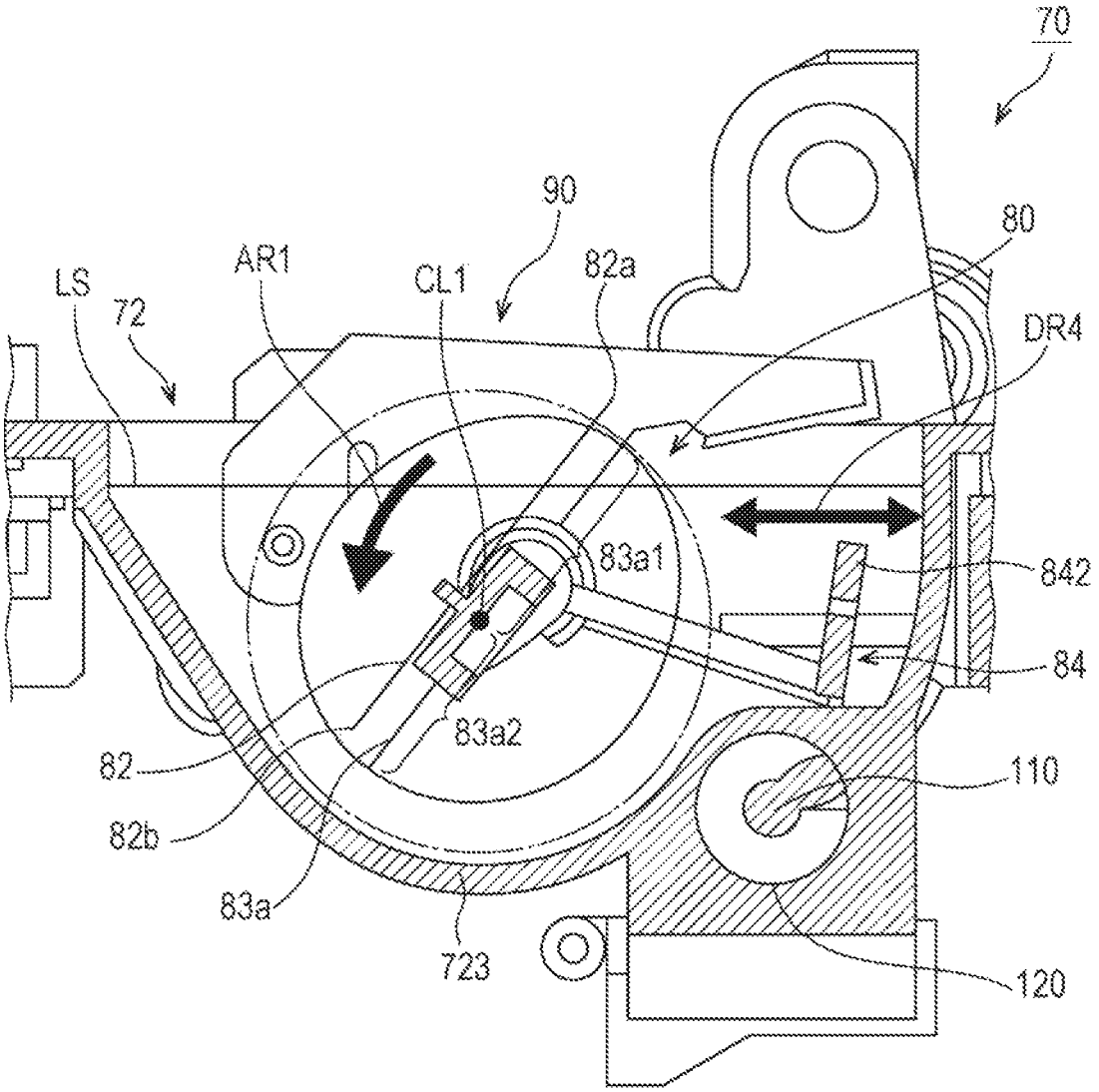
FIG. 8 is a sectional view illustrating the agitation member agitating toner in the toner replenishing apparatus according to the embodiment.

FIG. 8 is a sectional view illustrating the agitation member agitating toner in the toner replenishing apparatus according to the embodiment. How the agitation member 84 agitates toner will be described with reference to FIG. 8.

As illustrated in FIG. 8, as the rotation shaft 81 rotates, the agitation member 84 swings as indicated by an arrow DR4 in a direction that intersects with (more specifically in a direction orthogonal to) the rotation axis CL1.

As described above, the extension 841 of the agitation member 84 is arranged above the conveyance member 110. The agitation member 84 swings to agitate the toner in an area located above the conveyance member 110, which is a part of the toner stored in the toner storage 72. This suppresses accumulation and hardening of the toner in the area located above the conveyance member 110.

The agitation member 84 swings away from the screw part 83 when the first part 83*a*1 in the major axis 83*a* of the screw part 83 rotates toward the agitation member 84 (more specifically the extension 841), and swings toward the screw part 83 when the first part 83*a*1 rotates away from the agitation member 84 (more specifically the extension 841). This prevents the agitation member 84 from interfering with the screw part 83.

Moreover, the agitation paddle 82 has a plate-like configuration arranged parallel to the rotation axis CL1 as described above, and has a first end 82*a* that is farther from the rotation axis of the agitation paddle 82 (the rotation axis CL1) and a second end 82*b* that is nearer from the rotation axis of the agitation paddle 82 when viewed from the direction of the rotation axis CL1.

The agitation member 84 swings away from the agitation paddle 82 when the first end 82*a* of the agitation paddle 82 rotates toward the agitation member 84 (more specifically the extension 841), and swings toward the agitation paddle 82 when the first end 82*a* of the agitation paddle 82 rotates away from the agitation member 84 (more specifically the extension 841). This prevents the agitation member 84 from interfering with the agitation paddle 82.

Moreover, the extension 841 is arranged below a toner liquid surface LS against which the toner remaining amount detection member 91 abuts. This allows the agitation member 84 to agitate toner located below the toner surface LS against which the toner remaining amount detection member 91 abuts. This suppresses accumulation and hardening of the toner located below the toner surface LS against which the toner remaining amount detection member 91 abuts. This allows the toner to flow with stability.

Furthermore, the agitation member 84 agitates toner with the sensing plate 912 of the toner remaining amount detection member 91 away from the toner surface LS. This suppresses ripples on the toner surface LS caused by the agitation member 84 while the sensing plate 912 abuts against the toner liquid surface LS. This allows for accurate sensing of the amount of remaining toner.

As described above, the toner replenishing apparatus 70 according to the embodiment causes the agitation member 84 to agitate, along with movement of the agitation paddle 82, the toner located above the conveyance member 110, which is a part of the toner stored in the toner storage 72, even in a case in which the conveyance member 110 is arranged away from the agitation paddle 82 in a plan view. This prevents accumulation and hardening of the toner located above the conveyance member 110, which is a part of the toner stored in the toner storage 72, and allows the toner to flow with stability.

In the embodiment described above, the description gives an example of a case in which the agitation paddle 82 and the screw part 83 are secured to the rotation shaft 81. However, this example is not restrictive, and the agitation paddle 82 and the screw part 83 may be secured to different shafts. In this case, it is preferable that the rotation axis of the agitation paddle 82 and the rotation axis of the screw part 83 are parallel to each other.

In the embodiment described above, the description gives an example of a case in which the agitation member 84 agitates toner by swing of the extension 841 that extends along the rotation axis CL1, but this example is not restrictive. The configuration of the agitation member 84 can be changed as appropriate as long as the agitation member 84 is movable along with rotation of the agitation paddle 82. For example, the agitation member 84 may be formed by a screw or the like.

Although embodiments of the present invention have been described and illustrated in detail, the disclosed embodiments are made for purposes of illustration and example only and not limitation in all aspects. The scope of the present invention should be interpreted by terms of the appended claims, and includes all modifications within the meaning and range equivalent to the scope of the claims.

What is claimed is:

1. A toner replenishing apparatus comprising:

a toner storage that stores toner for replenishment;

an agitation paddle that is arranged in the toner storage and rotates to agitate toner stored in the toner storage;

a conveyance member that is disposed in a lower part of the toner storage and is used to convey the toner stored in the toner storage toward a developer; and an agitation member that moves along with rotation of the agitation paddle, wherein the conveyance member is arranged away from the agitation paddle in a plan view, and the agitation member is located above the conveyance member so as to agitate the toner located above the conveyance member, which is a part of the toner stored in the toner storage.

2. The toner replenishing apparatus according to claim 1, wherein the toner storage has an introduction port for introduction of the toner from a toner container to the toner storage and a toner take-in part that is connected with a replenishment path for replenishment of the toner to the developer to take the toner into the replenishment path, and the introduction port and the toner take-in part are located at positions where the introduction port and the toner take-in part do not overlap with each other in a plan view.

3. The toner replenishing apparatus according to claim 1, wherein the agitation member is fitted onto a shaft parallel to a rotation axis of the agitation paddle and swings in a direction that intersects with the rotation axis of the agitation paddle.

4. The toner replenishing apparatus according to claim 3, wherein the agitation member includes an extension that extends in a direction parallel to the rotation axis of the agitation paddle and a projection that projects upward from the extension.

5. The toner replenishing apparatus according to claim 4, wherein the projection is disposed on a first end side of the extension in the direction parallel to the rotation axis of the agitation paddle.

6. The toner replenishing apparatus according to claim 4, wherein the extension has a protrusion that protrudes downward, and the protrusion is slidable on a bottom of the toner storage.

7. The toner replenishing apparatus according to claim 4, wherein a movement limiting part that limits upward movement of the extension is disposed on an inner surface of the toner storage.

8. The toner replenishing apparatus according to claim 3, wherein the agitation paddle has a plate-like configuration and has a first end that is farther from the rotation axis of the agitation paddle and a second end that is nearer from the rotation axis of the agitation paddle when viewed from a direction of the rotation axis of the agitation paddle, and the agitation member swings away from the agitation paddle when the first end rotates toward the agitation member, and swings toward the agitation paddle when the first end rotates away from the agitation member.

9. A developer that develops a latent image formed on an image carrier and forms a toner image on the image carrier, wherein toner is replenished from the toner replenishing apparatus according to claim 1.

10. An image forming apparatus comprising:

the developer according to claim 9; and a transfer part that transfers the toner image developed by the developer to a recording medium.

11. The toner replenishing apparatus according to claim 1, wherein the agitation member includes an extension that extends in a direction parallel to a rotation axis of the agitation paddle and a projection that projects upward from the extension.

12. The toner replenishing apparatus according to claim 1, further comprising a screw portion which conveys the toner to the agitation paddle.

* * * * *